US005997367A

United States Patent [19]

Nowak et al.

[11] Patent Number: 5,997,367

[45] Date of Patent: Dec. 7, 1999

[54] ADAPTER

[75] Inventors: Scott W. Nowak, Londonderry, N.H.; Fred M. Finnemore, Jefferson, Me.; Charles S. Skoolicas, Nashua; Gary C. Keay, Merrimack, both of N.H.

[73] Assignee: VLT Corporation, San Antonio, Tex.

[21] Appl. No.: 09/195,401

[22] Filed: Nov. 19, 1998

Related U.S. Application Data

[60] Division of application No. 08/744,110, Nov. 5, 1996, which is a continuation-in-part of application No. 08/464,245, Jun. 5, 1995, abandoned.

[51] Int. Cl.[6] ..... H01R 11/22

[52] U.S. Cl. ..... 439/853; 439/82; 439/593

[58] Field of Search ..... 439/924.1, 682, 439/599, 92, 81, 82, 844, 853, 593

[56] References Cited

U.S. PATENT DOCUMENTS

| | | | |
|---|---|---|---|
| 2,407,998 | 9/1946 | Richardson | 439/617 |
| 2,747,167 | 5/1956 | Parrish | 439/677 |
| 2,814,024 | 11/1957 | Narozny | 439/82 |
| 3,158,425 | 11/1964 | Pritulsky | 339/258 |
| 3,288,915 | 11/1966 | Hatfield et al. | 174/94 R |
| 3,334,395 | 8/1967 | Cook et al. | 29/852 |
| 3,368,188 | 2/1968 | Olsson | 339/275 |
| 3,504,328 | 3/1970 | Olsson | 339/17 |
| 3,654,583 | 4/1972 | Mancini | 439/83 |
| 3,699,495 | 10/1972 | Raynor | 339/17 C |
| 3,745,512 | 7/1973 | Johnson et al. | 439/599 |
| 3,778,755 | 12/1973 | Marks | 339/217 R |
| 3,899,232 | 8/1975 | Berg et al. | 339/17 C |
| 3,945,700 | 3/1976 | Didier | 439/599 |
| 4,012,107 | 3/1977 | Cobaugh et al. | 339/258 P |
| 4,181,387 | 1/1980 | Walters | 339/17 C |
| 4,266,838 | 5/1981 | Segrott | 339/17 C |
| 4,346,419 | 8/1982 | Janniello | 361/2 |
| 4,470,649 | 9/1984 | Spencer et al. | 339/17 C |
| 4,515,422 | 5/1985 | Pritulsky | 339/17 C |
| 4,579,404 | 4/1986 | Lockard | 439/92 |
| 4,657,336 | 4/1987 | Johnson et al. | 339/258 R |
| 4,797,110 | 1/1989 | Ponziani et al. | 439/83 |
| 4,842,552 | 6/1989 | Frantz | 439/557 |
| 4,878,851 | 11/1989 | Mullen, III | 439/83 |
| 4,946,408 | 8/1990 | Garrett et al. | 439/872 |
| 5,131,853 | 7/1992 | Meyer | 439/82 |
| 5,427,541 | 6/1995 | Calio | 439/246 |

FOREIGN PATENT DOCUMENTS

| | | | |
|---|---|---|---|
| 0 367 903 A2 | 5/1990 | European Pat. Off. | H01R 13/514 |
| 90 01 340 | 7/1991 | Germany | H01R 13/11 |
| 42 27 007 A1 | 2/1994 | Germany | H01R 1/38 |
| 53-143083 | 11/1978 | Japan | H01R 7/18 |
| 5-82075 | 11/1993 | Japan | H05K 1/18 |

OTHER PUBLICATIONS

Crane Connectors drawing of Vicor contract, Oct. 27, 1994.
Berg Electronics, Berg Griplet Terminal drawing and Designer's Guide page. No date.
Garry Precision Screw Machine, drawing #AL300, Dec. 20, 1994.
Palco Connector drawing. No date.
Multi–Contact drawings, memos Oct., 1994.
Hugin Industries, Inc. drawing. No date.
Multi–Contact drawings. No date.
Mill–Max Mfg. Corp. drawing, Jun. 27, 1994.
Instrument Specialties Co., Inc., Product Design & Shielding Selection Guide, Sep., 1994.

*Primary Examiner*—Renee S. Luebke
*Assistant Examiner*—Javaid Nasri
*Attorney, Agent, or Firm*—Fish & Richardson P.C.

[57] ABSTRACT

A connector for a pin includes a support ring, and a contact ring of fingers that are (i) connected to and integrally formed with the support ring, (ii) held in a space within the support ring, (iii) define a channel within the contact ring for receiving the pin, (iv) are resilient with respect to the outer support to apply radially inward forces on the pin, and (v) have a curved inner profile to increase the surface area in contact with the pin. A resilient element may be placed in the space between the support ring and contact ring.

43 Claims, 15 Drawing Sheets

ADAPTER

This application is a divisional of application Ser. No. 08/744,110, filed Nov. 5, 1996 which is a continuation-in-part of U.S. patent application Ser. No. 08/464,245, filed Jun. 5, 1995 now abandoned.

BACKGROUND

This invention relates to connectors.

Power converters, for example, are sometimes connected to printed circuit boards by inserting their pins into round electrical connectors mounted on the boards. The connector may have internal tabs that grab the pin.

SUMMARY

In general, in one aspect, the invention features a connector for a pin. The connector has a support ring and a contact ring connected to and integrally formed with the support ring, held in a space within the support ring and defining a channel within the contact ring for receiving the pin. The contact ring has fingers arranged radially around the contact ring. The contact ring is configured to provide a contact region contacting the pin along its length when the pin is inserted.

Implementations of the invention may include one or more of the following. The contact region may be cylindrical. At least one of the fingers may have a cylindrical inner surface for contact with a cylindrical outer surface of the pin. The fingers of the contact ring may be resilient with respect to the support ring to apply radially inward forces on the pin. The connector may also have a resilient element held in a space between the support ring and the contact ring. The resilient element may include a material that expands with rising temperature. The resilient element may include silicone rubber. The resilient element may be molded to conform to the space between the support ring and the contact ring before the pin is inserted. The channel may include a contact zone which is located along a longitudinal axis of the channel and is narrower than an outside circumference of the pin.

Each of the fingers, when the pin is inserted within the connector, may touch the inside of the support ring at a point which is on the other end from where the finger is connected to the support ring. The support ring and the contact ring may be formed by cutting and bending. The support ring may be cylindrical. The support ring may be split by a longitudinal gap. The support ring may be a circumferentially continuous closed ring. The contact ring may be split by a longitudinal gap. The contact ring may be a circumferentially continuous closed ring. The contact ring may be cylindrical and defined by fingers arranged at generally equal intervals around the contact ring. Each of the fingers may include a contact zone that is flat along the length of the finger. Each of the fingers may include a contact zone that is longitudinally convex with respect to the channel prior to insertion of the pin, and is flat after insertion of the pin. The support ring may have an outer wall, and the outer wall may include a stop, at one end, that extends outwardly from the outer wall. The connector may also have a cap including a top surrounded by a rim, the rim fitted between the support ring and the contact ring. The edge of the support ring may be rolled over the top of the cap. The fingers may be gold-plated. A housing ring may surround the support ring. The pin and the connector may be both conductive.

In general, in another aspect, the invention features a connector for a pin. The connector has a cylindrical support ring and a cylindrical contact ring of fingers that are connected to and integrally formed with the support ring, are arranged at generally equal intervals around the contact ring, are held in a space within the support ring, and define a channel within the contact ring for receiving the pin, the channel including a contact zone which is located along a longitudinal axis of the channel and is narrower than an outside circumference of the pin, the contact zone being configured to be in contact with the pin along its length when the pin is inserted. The fingers are resilient with respect to the support ring to apply radially inward forces on the pin.

In general, in another aspect, the invention features a connector for a pin. The connector has a support ring, a contact ring spaced apart from the support, for making contact with and applying a force to the pin, and a resilient ring held in the space between the support ring and the contact ring. The resilient ring expands with increased temperature and is configured so that as it expands it applies a force to the contact ring which enhances the force applied by the contact ring to the pin.

Implementations of the invention may include one or more of the following. The resilient material may include silicone rubber. The resilient ring may be molded to conform to the space between the support ring and the contact ring before the pin is inserted. The contact ring may have contact fingers contoured to retain the resilient ring in the space between the support ring and contact ring.

In general, in another aspect, the invention features a connector for a pin. The connector has a support ring and a contact ring of fingers that are connected to and integrally formed with the support ring, are held in a space within the support ring, and define a channel within the contact ring for receiving the pin. The fingers are resilient with respect to the support ring to apply radially inward forces on the pin. Each of the fingers, when the pin is inserted within the connector, touches the inside of the support ring at a point which is on the other end from where the finger is connected to the support ring.

In general, in another aspect, the invention features a connector for a pin. The connector has a support ring and a contact ring of fingers that are connected to and integrally formed with the support ring, are held in a space within the support ring, and define a channel within the contact ring for receiving the pin. The fingers are resilient with respect to the support ring to apply radially inward forces on the pin. The connector also has a cap including a top surrounded by a rim, the rim fitted between the support ring and the contact ring.

In general, in another aspect, the invention features a connector for a pin. The connector has a support ring and a contact ring connected to and integrally formed with the support ring, held in a space within the support ring and defining a channel within the contact ring for receiving the pin. The contact ring has fingers arranged radially around the contact ring, and the contact ring is configured to provide a contact region contacting the pin along its length when the pin is inserted. At least one of the fingers has a bent zone near a free end of the finger that is concave with respect to the support ring.

Implementations of the invention may include one or more of the following. The free end of at least one of the fingers may be held in space prior to insertion of the pin and may contact the support ring after insertion of the pin. The free end of at least one of the fingers may be held in space after insertion of the pin. The pin may have a contact surface, and at least one of the fingers may have an inner surface contoured to the contact surface of the pin. The connector may also have at least one tab located between adjacent fingers. The tab is connected to and integrally formed with the support ring. The tab is held in space within the support ring and is closer to the support ring than the adjacent fingers. The connector may have exactly four or exactly six fingers.

In general, in one aspect, the invention features a connector for a pin. The connector has a support ring and a contact ring of fingers that are connected to and integrally formed with the support ring, are held in a space within the support ring, and define a channel within the contact ring for receiving the pin. The fingers are resilient with respect to the support ring to apply radially inward forces on the pin. At least one of the fingers has a free end that is held in space prior to insertion of the pin and contacts the support ring after insertion of the pin.

In general, in another aspect, the invention features an adapter for connecting a low current wire to a smaller diameter low current pin and a high current wire to a larger diameter high current pin. The adapter has a housing and a first connector located inside the housing. The first connector is configured to grip the low current pin and form an electrical connection between the low current pin and the low current wire. The adapter also has a second connector located inside the housing configured to grip the high current pin and form an electrical connection between the high current pin and the high current wire.

Implementations of the invention may include one or more of the following. The adapter may also have a frame mounted to the first and second connectors. The second connector may have a sleeve for gripping the high current wire. The adapter may also have a lug configured to receive the low current wire and a printed circuit board mounted to the first connector. The board has a trace electrically connecting the lug to the first connector.

In general, in another aspect, the invention features an adapter for use with a first connector and a pin. The adapter has a housing and a socket formed in the housing. The adapter is configured to receive and form an electrical connection with the first connector when the first connector is inserted into the socket. The adapter also has a second connector electrically connected to the socket. The second connector is configured to engage and form an electrical connection with the pin.

Implementations of the invention may include one or more of the following. The adapter may have a lug mounted to the second connector and electrically connected to the socket. The adapter may also have a frame mounted to the second connector. The connector may include at least one finger that is resilient with respect to the support ring to apply radially inward forces on the pin.

In general, in another aspect, the invention features an apparatus for use with a pin and a printed circuit board. The apparatus has a frame configured to mount on a surface of the printed circuit board and connectors mounted to the frame. At least one of the connectors has a support ring and fingers connected to and integrally formed with the support ring, held in a space within the support ring and defining a channel within the contact ring for receiving the pin.

Implementations of the invention may include one or more of the following. The printed circuit board may have a hole, and the frame may have a peg configured to extend into the hole. The frame may have an opening through which at least one of the connectors extends. The apparatus may also have at least one ring configured to secure one of the connectors to the frame. The printed circuit board may have an electrical trace, and wherein the ring may be configured to form an electrical connection between the electrical trace and the one of the connectors secured by the ring. The frame may be elongated, and wherein the connectors may be mounted in a single row along the longitudinal length of the frame.

The advantages of the invention may include one or more of the following. The connector makes a good, high current, low resistance electrical connection in a low profile assembly. The connector also makes a good mechanical connection. The connector may be fabricated as a one-piece drawn part and used without a housing, or formed and rolled from flat stock and used with a housing. The pins are not damaged (e.g., a tin plating is not scraped off) by insertion, which maintains the electrical contact. Decreasing contact resistance with rising temperature is provided by increased force due to the expansion of the rubber ring. Cables can be quickly connected and disconnected from the pins using the adapter. Both low current and high current wires can be connected with a single adapter. A power converter module may be quickly connected and disconnected from the surface of a printed circuit board.

Other advantages and features will become apparent from the following description and from the claims.

DESCRIPTION

FIGS. 1*a* and 1*b* are cross-sections of a pin and a connector in two stages of insertion.

FIGS. 2*a–e* is a sequence of views of the process of making the connector.

Figure 5A:
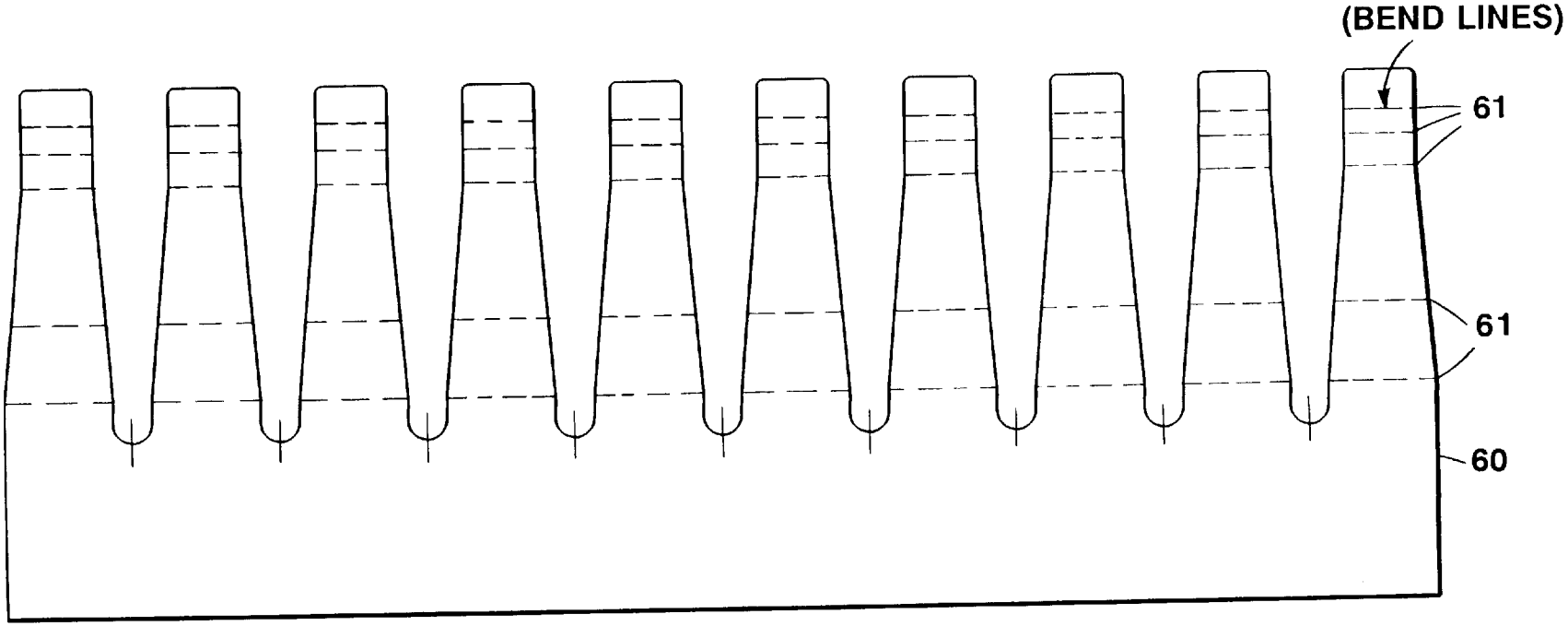

FIG. 5*a* is a plan view of a cut blank.

Figure 5B:
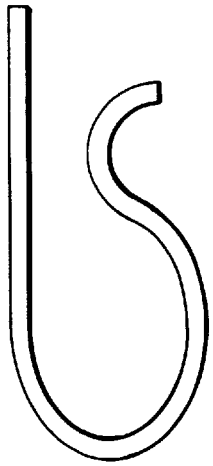

FIG. 5*b* is a cross-sectional view of a finger.

Figure 5C:
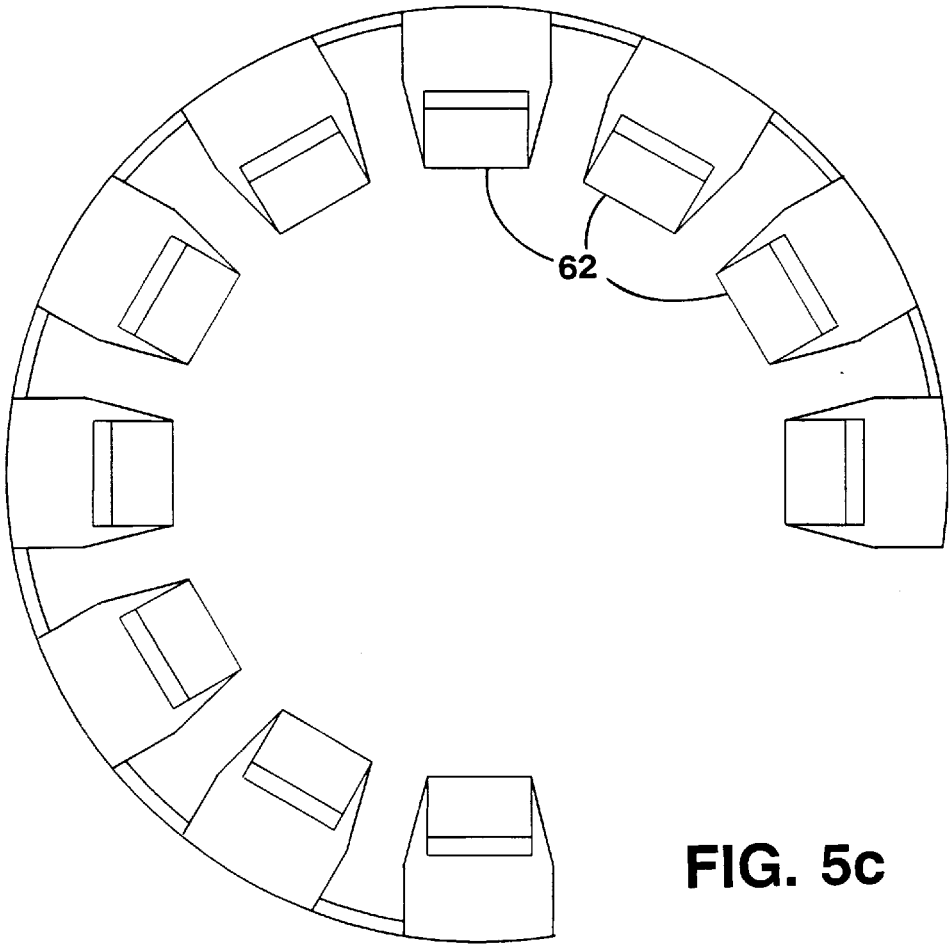

FIG. 5*c* is a top view of the blank of FIG. 5A curled.

Figure 6A:
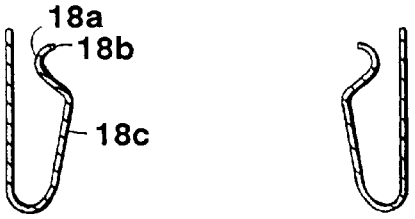
Figure 6B:
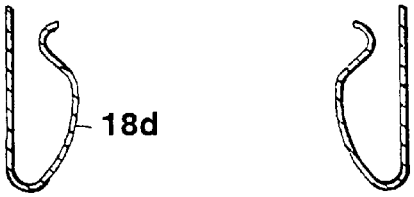
Figure 6C:
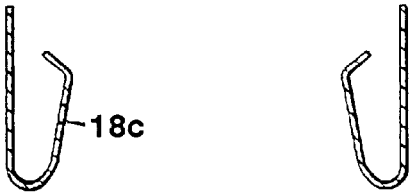
Figure 6D:
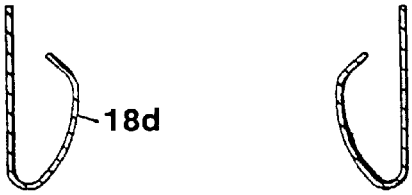
Figure 6E:
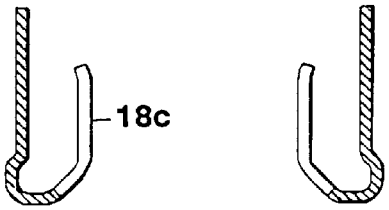
Figure 6F:
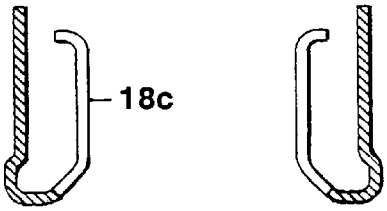

FIGS. 6*a–*6*f* are cross-sections of fingers.

Figure 7A:
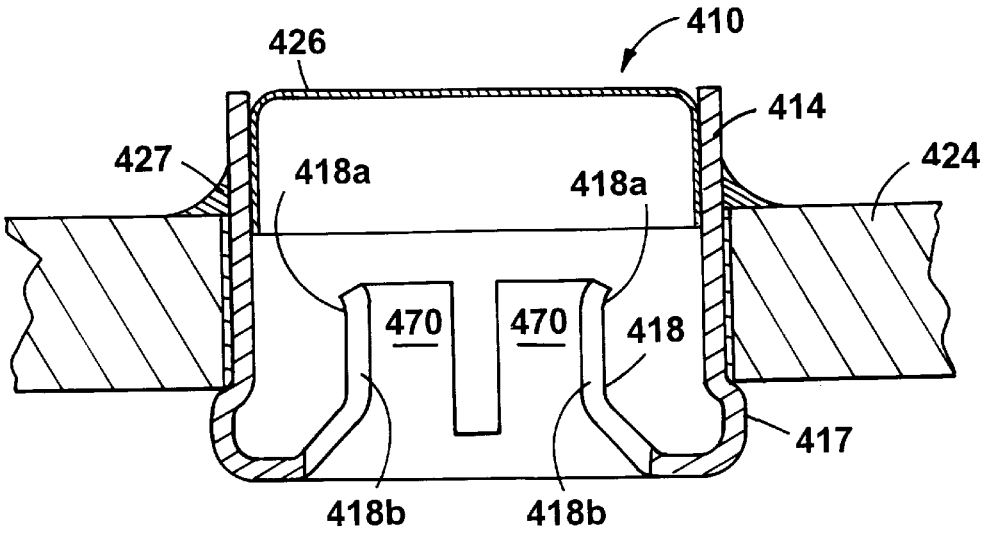

FIG. 7*a* is a cross-sectional view of another connector.

Figure 7B:
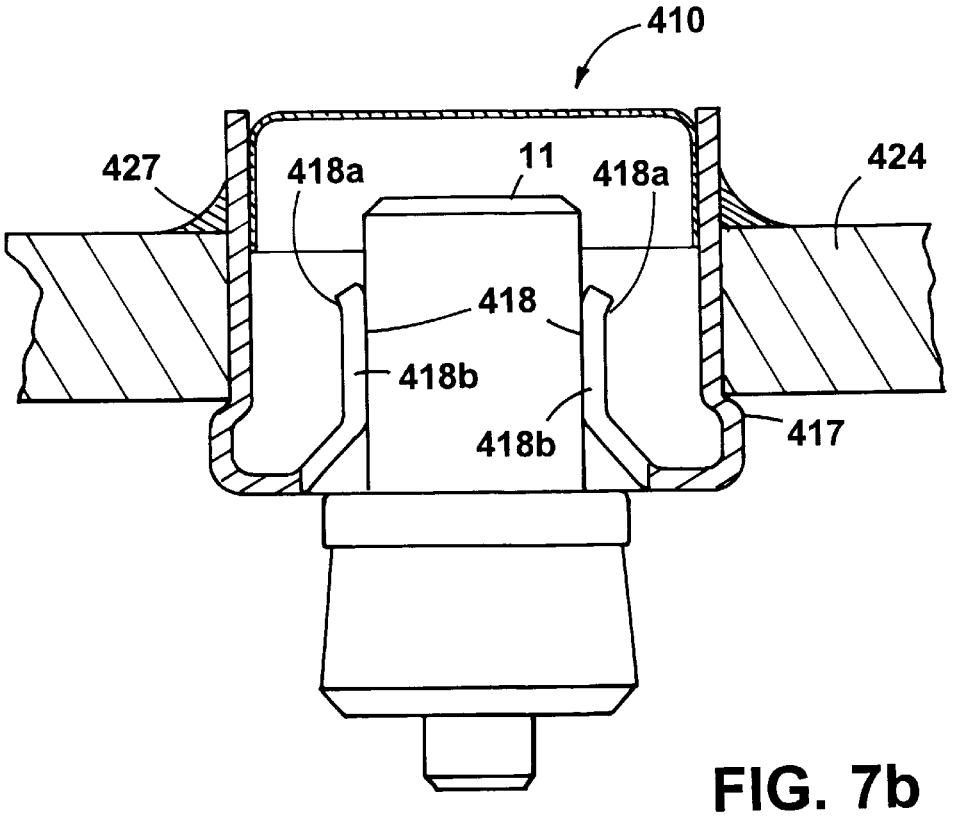

FIG. 7*b* is a cross-sectional view of the connector of FIG. 7*a* with a pin inserted.

Figure 8A:
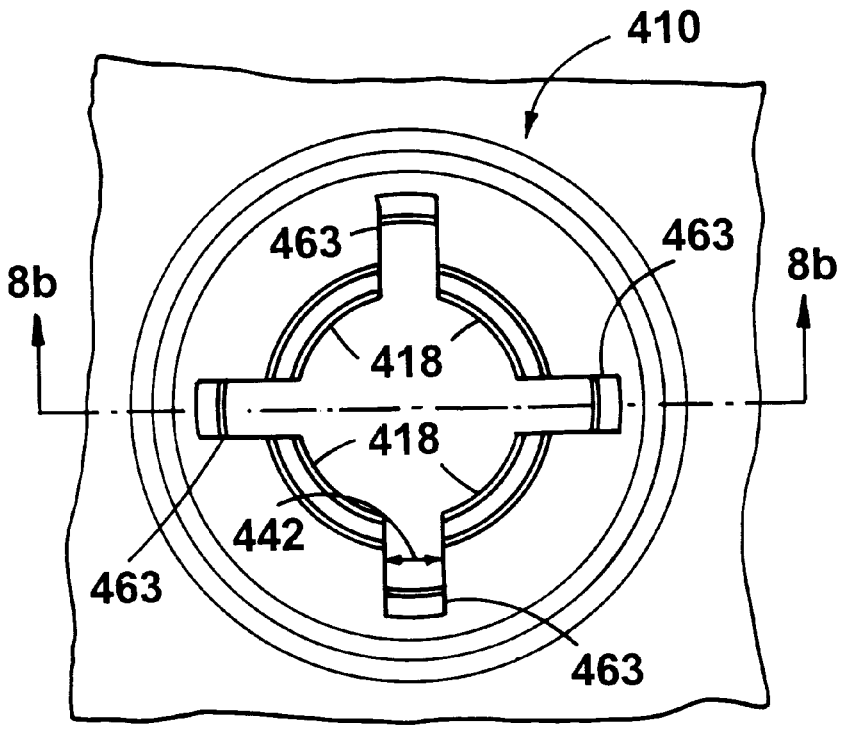

FIG. 8*a* is a top view of a four finger connector.

Figure 8B:
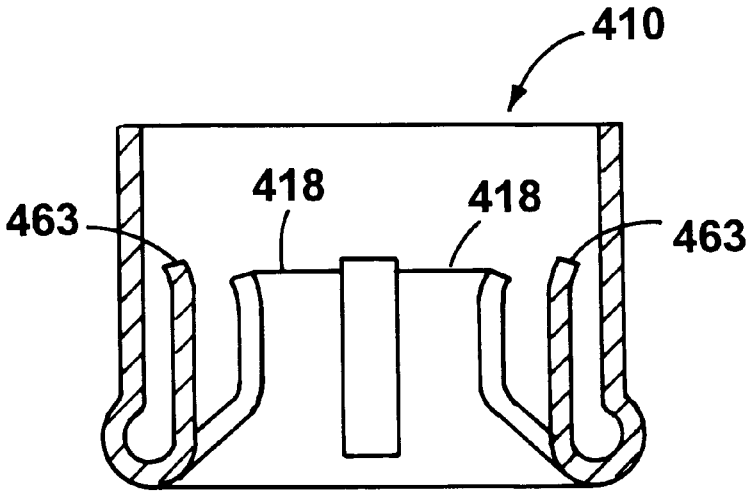

FIG. 8*b* is a cross-sectional view of the connector of FIG. 8*a* taken along line 8*b*–8*b*.

Figure 9A:
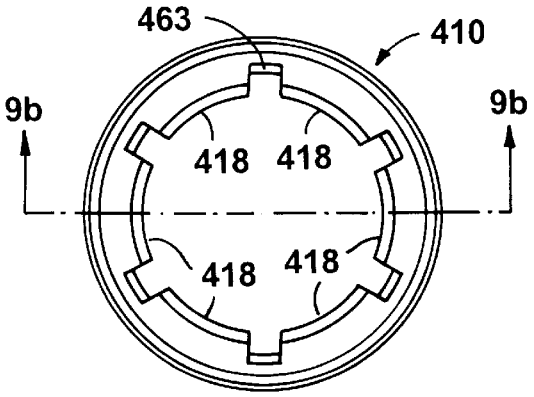

FIG. 9*a* is a top view of a six finger connector.

Figure 9B:
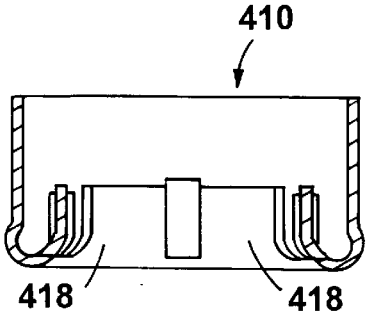

FIG. 9*b* is a cross-sectional view of the connector of FIG. 9*a* taken along line 9*b*–9*b* of FIG. 9*a*.

Figure 10:
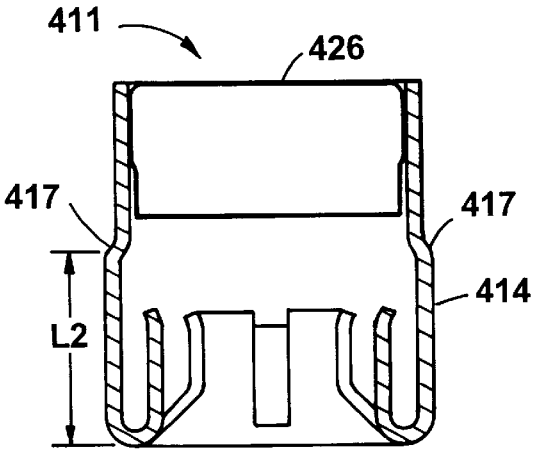

FIG. 10 is a cross-sectional view of another connector with a cap.

Figure 11:
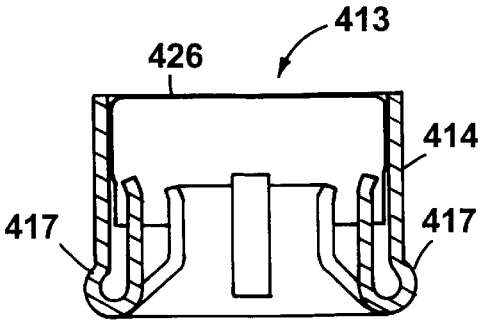

FIG. 11 is a cross-sectional view of another connector with a cap.

Figure 12:
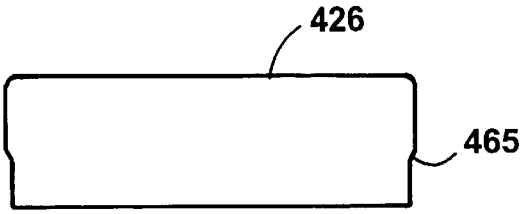

FIG. 12 is a cross-sectional view of a cap.

Figure 13:
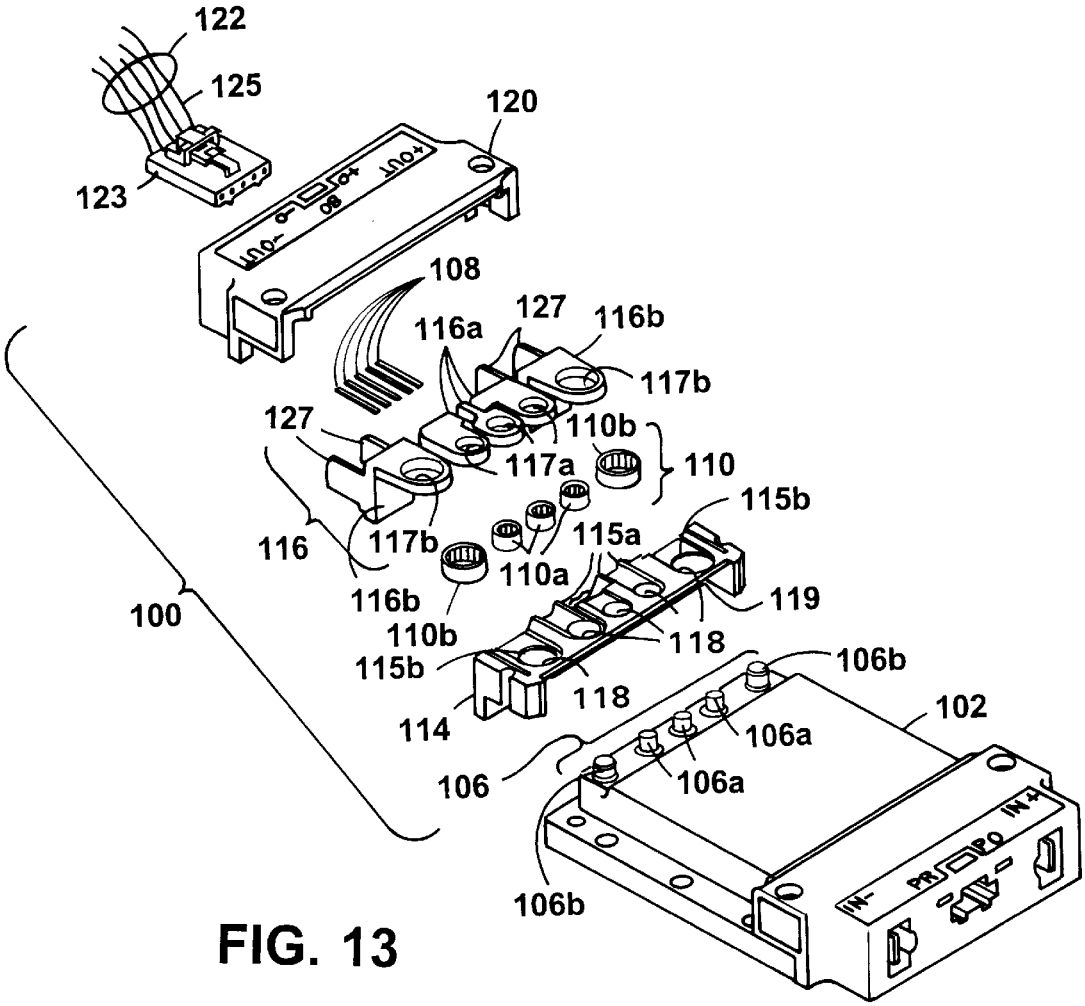

FIG. 13 is a top-down exploded view of an adapter.

Figure 14:
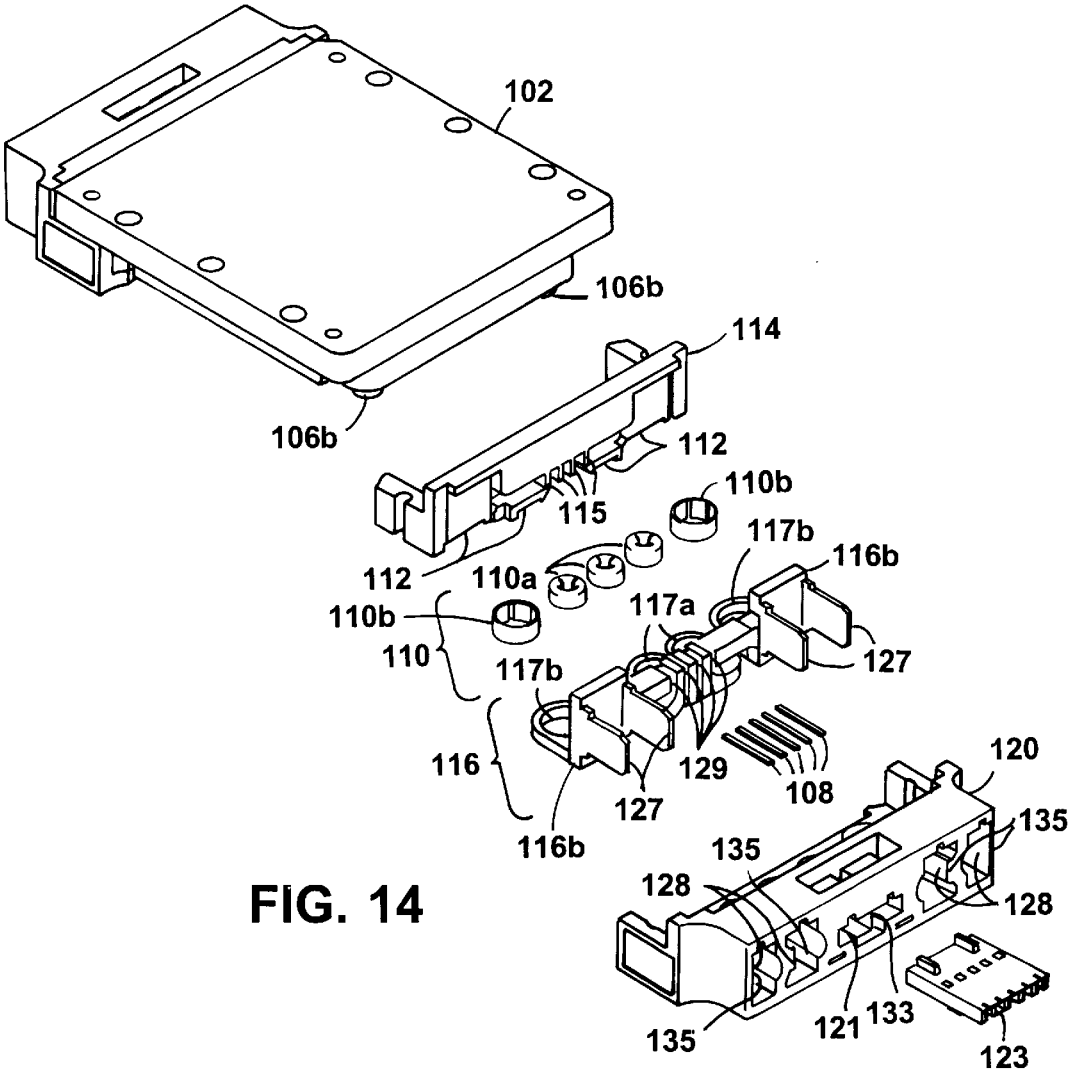

FIG. 14 is a bottom-up exploded view of the adapter of FIG. 13.

Figure 15:
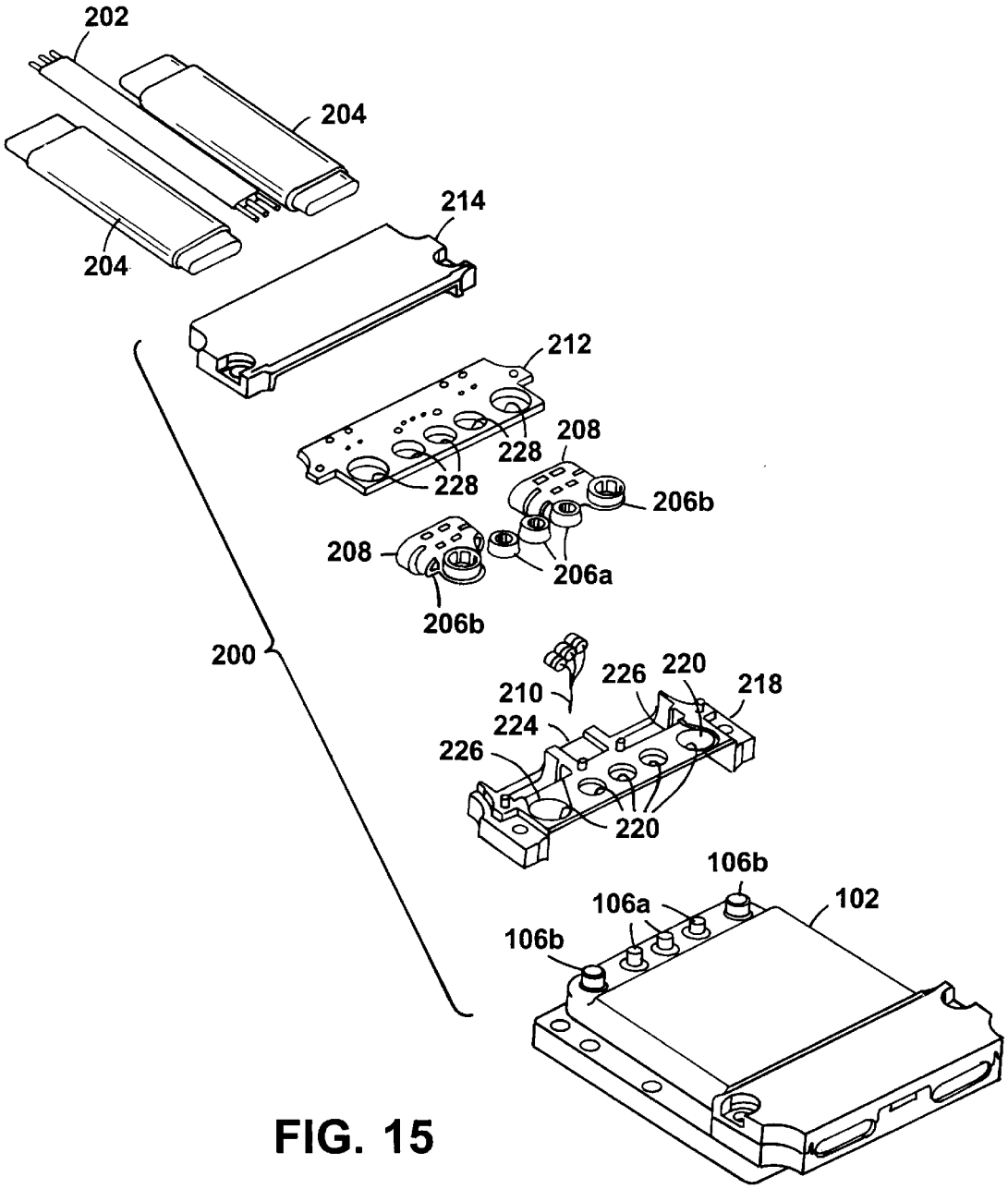

FIG. 15 is a top-down exploded view of an adapter.

Figure 16:
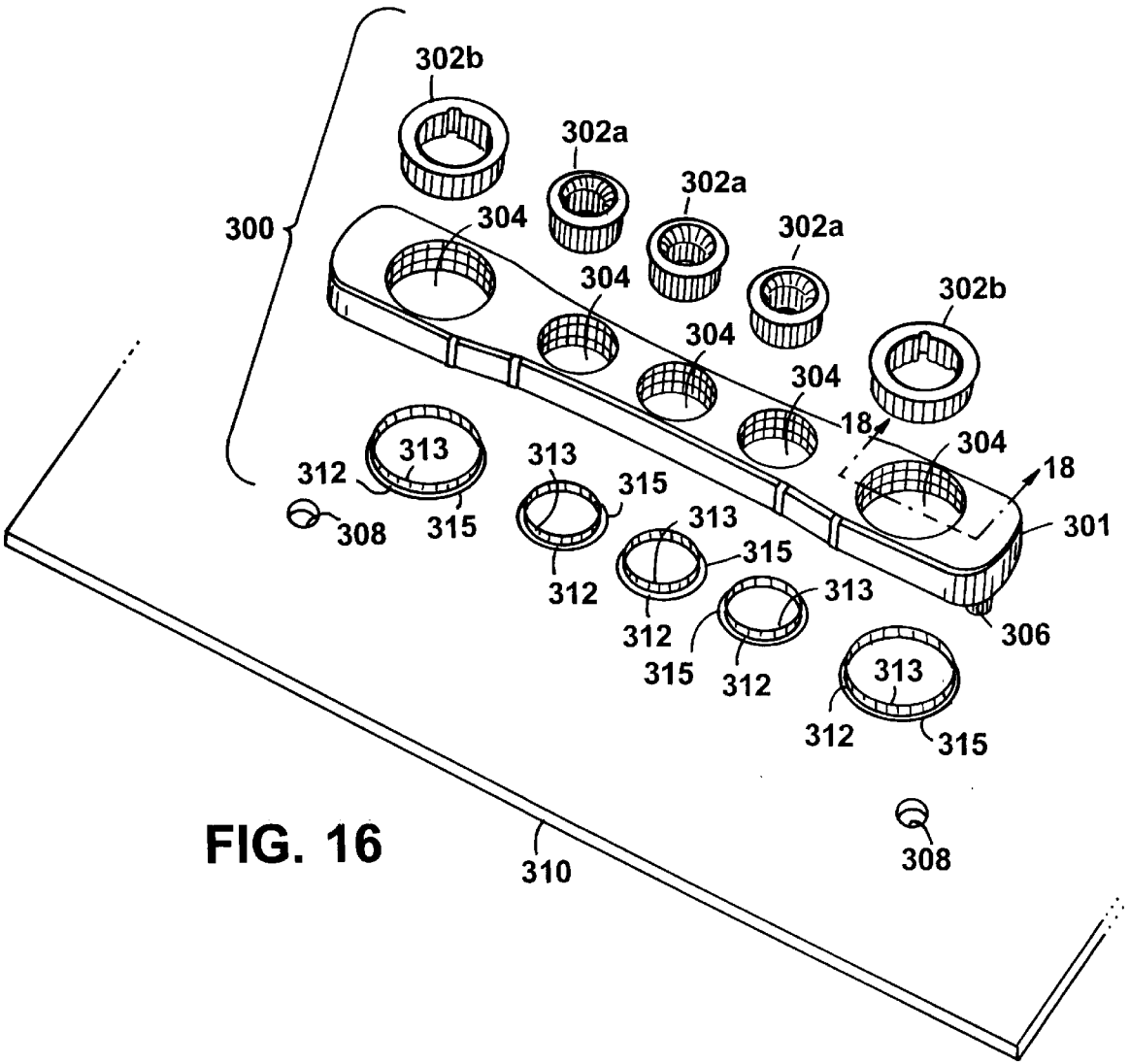

FIG. 16 is a top-down exploded view of a surface mount adapter.

Figure 17:
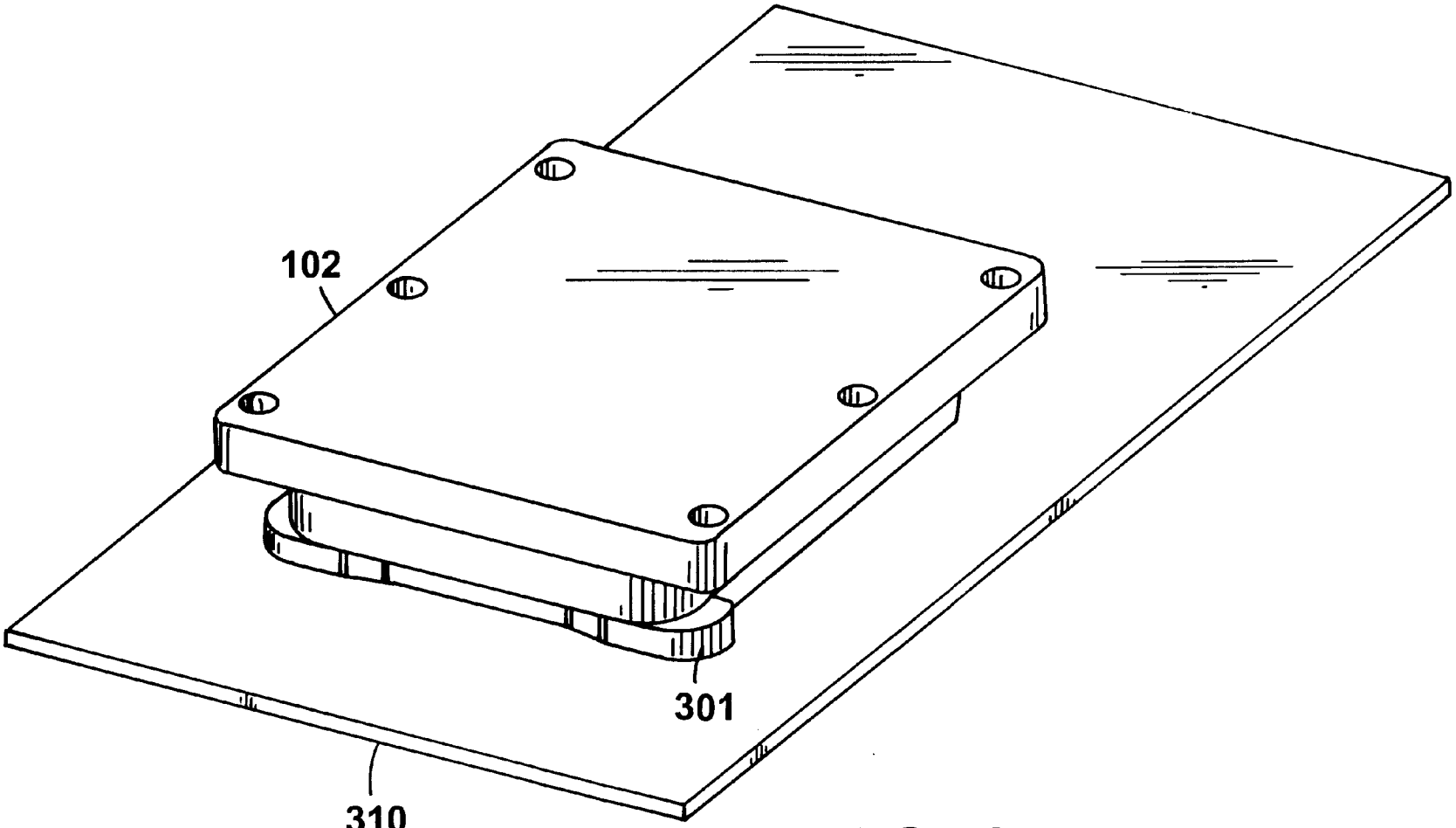

FIG. 17 is a top-down view of a power converter module mounted to the adapter of FIG. 16.

Figure 18:
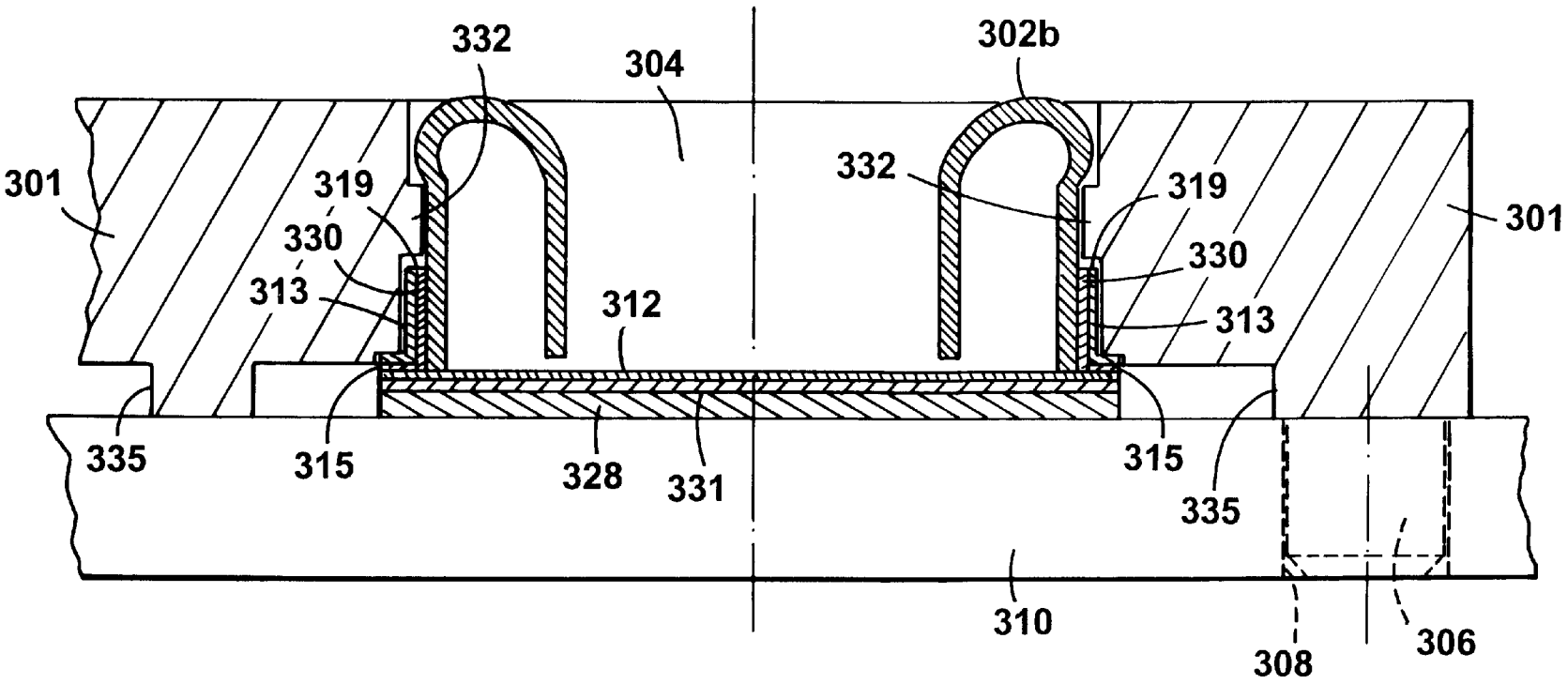

FIG. 18 is a cross-sectional view of the adapter taken along line 18—18 of FIG. 16.

Figure 1A:
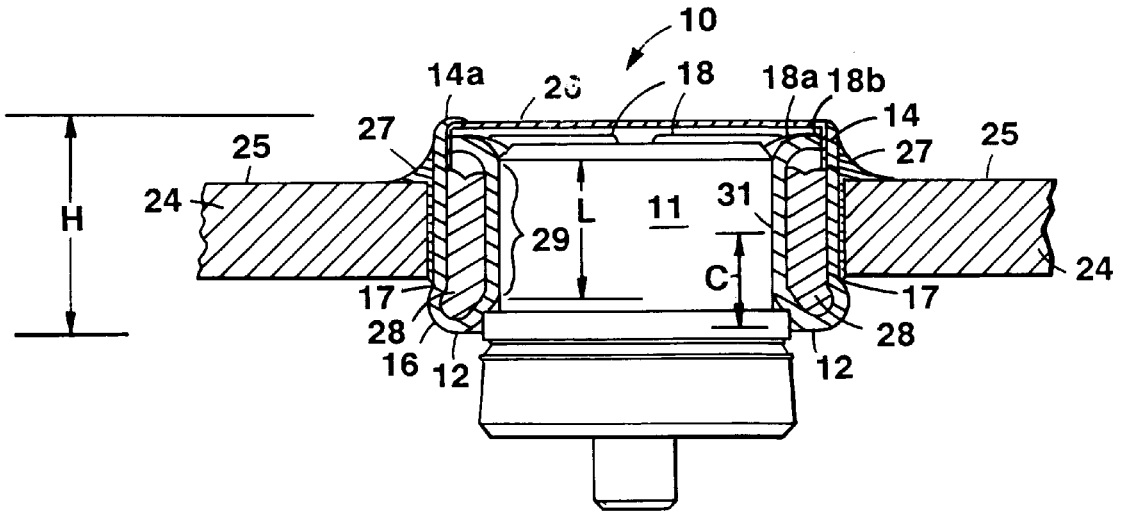
Figure 1B:
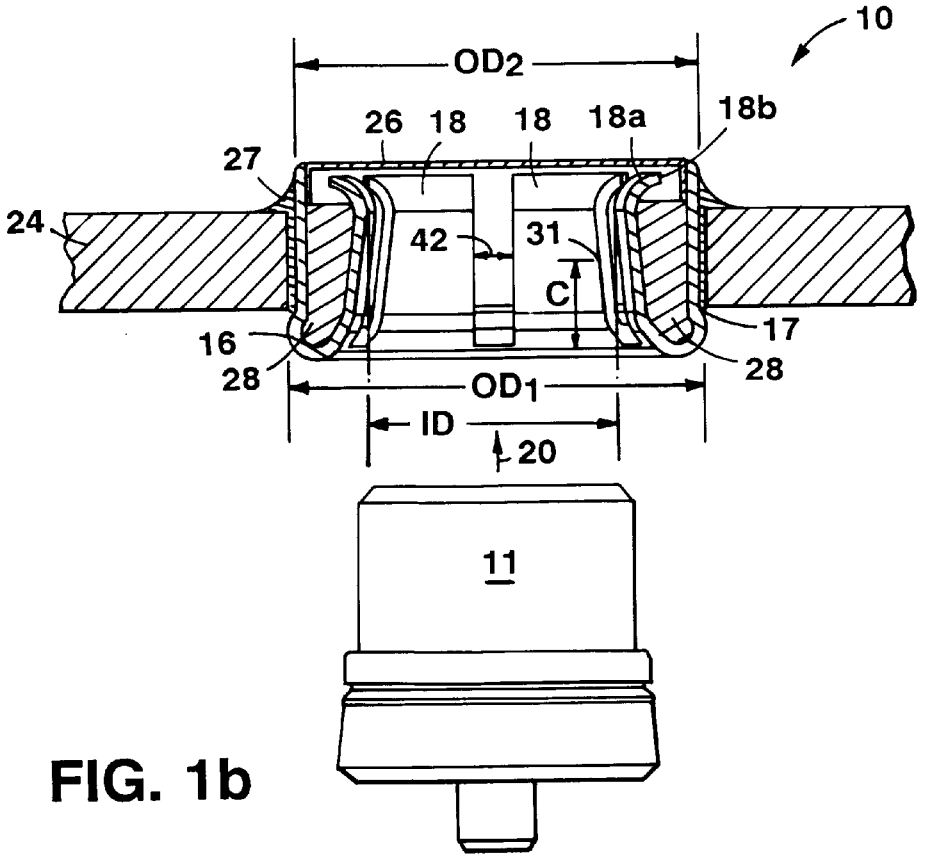

Referring to FIG. 1*a*, a pin 11 of an electronic component (not shown) is grasped in a connector 10 (which is press-fit in a hole in a printed circuit board (PCB) 24). The connector includes a beryllium copper crown 12 that is deformed when the pin is inserted (arrow 20) from a position shown in FIG. 1*b* to the position shown in FIG. 1*a*. The crown has a double-backed configuration in which an outer support ring, or cylinder 14, supports a concentric inner cylindrical contact ring of six fingers 18. This configuration aids the fingers in applying force to the pin when inserted. A high temperature silicone (rubber) ring 28 is molded to fit in the space between the outer cylinder 14 and the framework of fingers 18. The ring 28 is compressed by the insertion of the pin 11, and provides an additional even force along the finger, and, thus, against the pin 11, especially when increasing temperature causes expansion of the ring 28.

As seen in FIG. 1*a*, when the pin 11 is in place in the connector, the deformation of each finger provides a contact zone 29 having a length L, and a central contact point 31 which is midway along the length L of the contact zone. To reduce the resistance, e.g., 160 $\mu$ohms, of the contact, L is made long to increase the contact area. Conversely, for a short (low profile) connector, L should be small to reduce the height H of the connector. The contour of the finger is chosen to meet these needs.

The fingers 18 have curved surfaces 18*a* at their upper ends. When the fingers 18 are deformed, the end 18*b* of each finger 18 makes contact with the outer cylinder 14 to provide a connection with even lower resistance and greater contact force. The fingers 18 also retain the ring 28.

In use, the current, e.g., 100–140 amps, through the connector causes the temperature of the fingers 18, and the ring 28, to rise. Because the ring 28 has a certain stiffness (durometer of 54 shore A) the expansion of the ring 28 as the temperature rises will apply additional force radially against the fingers 18 and in turn between the fingers 18 and the pin 11. Normally as temperature of the contact between the pin 11 and the fingers 18 rises, the resistance also rises (due to the properties of the pin and finger materials). The increased force applied by the expanding ring 28 tends to offset the increased resistance by increasing the area of contact.

An extension 16 of each finger 18 links the finger to the outer cylinder 14, and is formed to provide a stop 17 which strikes the bottom of the PCB 24 when the connector is press-fit. The outer cylinder 14 is long enough to project to at least the top 25 of the PCB 24 (and sometimes even beyond, as in the case of FIG. 1*a*). This permits easy soldering 27 of the connector to the PCB 24. Before soldering, a stainless steel cap 26 is press-fit into the inside of the outer cylinder 14 to prevent solder from entering the inside of the connector when the connector is wave-soldered to the PCB 24. The cap 26 fits in the space between the fingers 18 and the outer cylinder 14. The edge 14a of the outer cylinder 14 is rolled over the cap 26 to provide further retention.

Referring to FIG. 2, to make the connector, disks 30 (one for each connector) are die cut from a strip 32 of beryllium copper. Each disk is drawn to form a cup 34. Next a central cylinder 36 is formed by drawing. A hole 38 is eventually formed at the upper end of the central cylinder 36. The fingers 18 are then cut by punching and are given their final form. Next, the stops 17 are formed in the outer cylinder 14. The connector is then heat treated to harden and impart spring-type properties to the beryllium copper, after which the ring 28 is inserted by holding the fingers 18 together.

Figure 3:
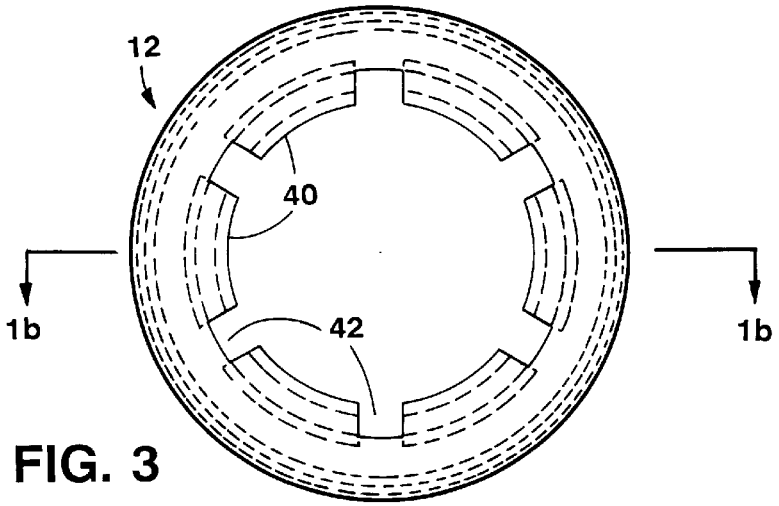
FIG. 3 is a bottom view of the connector.

Referring to FIG. 3, as a result of the process of drawing the fingers, they adopt a curved inner profile 40, which is structurally strong (and, thus, can apply a strong force to the pin) and similar in profile to the pin, to yield a larger contact area. Smaller gaps 42 between adjacent fingers yield greater contact area. A greater number of fingers also increases the contact area and lessens the chance that off-center pin insertion will damage the fingers.

In one example the connector has a first outer diameter $OD_1$ (FIG. 1*b*) of 0.270" and a second outer diameter $OD_2$ of 0.262", an inner diameter ID of 0.178", a height H of 0.135", and a gap 42 between fingers of 0.025". L is 0.057" and C is 0.051". The fingers have a thickness of 0.008". The thickness of the fingers affects their resilience and the dimensions of the connector. The interference fit between the fingers and the pins is 0.002–0.015", depending upon the application.

Figure 4:
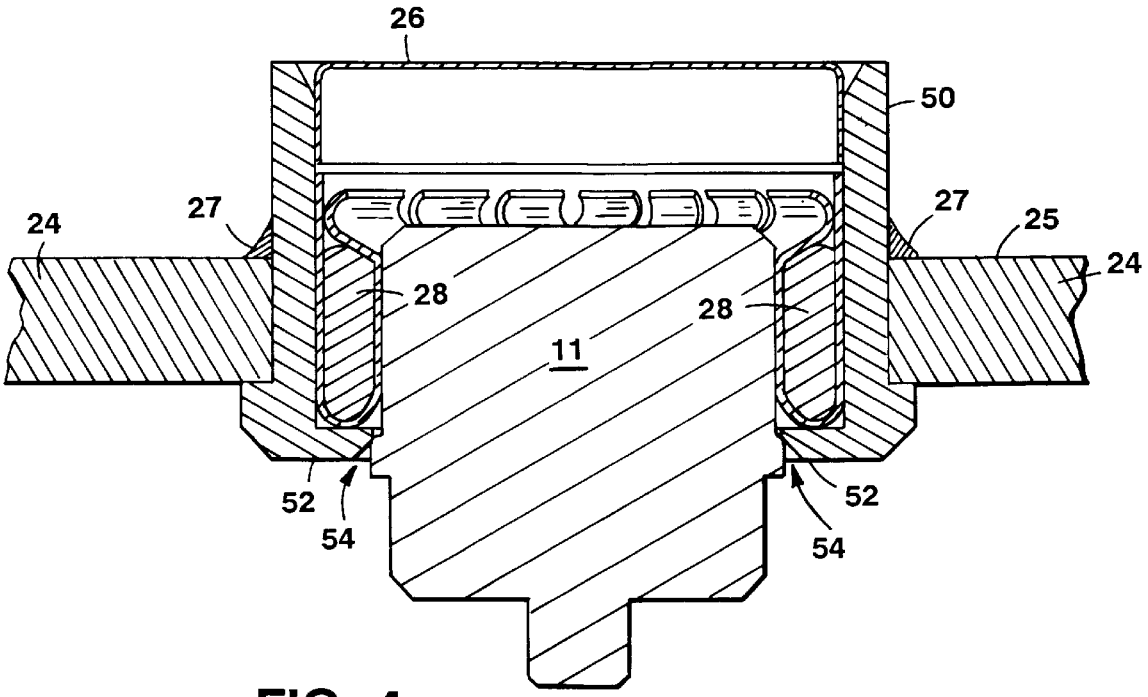
FIG. 4 is a cross-sectional view another connector.

For example, as shown in FIG. 4, the connector may be held in a cylindrical copper housing 50 that has a rim 52 at the bottom with a hole 54 to receive the pin. The connector is soldered to the housing by a solder dipping process followed by a centrifuge operation that spins off excess solder and prevents the fingers from being soldered together. It is the housing, not the outer cylinder of the crown, that is soldered to the PCB.

The housing is capable of holding a connector that is drawn (not shown) or a connector that is formed by cutting and bending (along the dashed lines 61) a blank 60 of heat treated beryllium copper, as shown in FIG. 5*a*, to form fingers having the contour shown in FIG. 5*b*, and curling it in a circle as shown in FIG. 5*c*. The cross-sectional profile 62 of the finger is flat (unlike the curve 40 of FIG. 3). Once curled, the crown is squeezed together and placed into the housing. The inside diameter of the housing is set to impart the desired diameter to the inserted crown. The crown material may be thinner when a housing is used.

Referring to FIGS. 6*a*–6*f*, the fingers may also be shaped with a flat contact surface 18*c* to insure a long contact length, or they may be shaped with a slight bow 18*d*, or convex surface, which is deformed to be flat during insertion and provides even greater contact force.

The crown need not have a stop.

The connector could be used to provide only mechanical support in some applications, rather than also making an electrical connection.

Some applications, for example, burn-in test chambers, require repetitive pin insertions and subject the connectors to higher than normal current flow. In such an application, the crown may be gold plated to provide continuously reliable electrical connections.

As shown in FIGS. 7*a* and 7*b*, in another embodiment, a connector 410 is formed from a support ring 414 and a contact ring formed from fingers 418. The fingers 418 have free ends 418*a* suspended in space within the contact support ring 414. For purposes of having the finger 418 conform to the shape of the pin 11 (to reduce the resistance of the contact), each finger 418 has a cylindrical surface 470 which increases the area of contact between the finger 418 and the pin 11. The connector 410 does not have a resilient ring between the fingers 418 and the support ring 414.

Each finger 418 has a linear region 418*b* which extends along the longitudinal axis of the pin 11 when inserted. For purposes of maximizing contact between the linear region 418*b* of the finger 418 and the pin 11, the distance between diametrically opposed finger 418 is only slightly smaller (e.g., by 0.002 inches) than the diameter of the pin 11 (i.e., the fingers 418 are only slightly biased).

Near the free end 418*a* of each finger 418, the finger 418 is slightly bent toward the support ring 414; however, the free end 418*a* of the finger 418 does not touch the support ring 414 when the pin 11 is inserted into the connector 410. The fingers 418 extend approximately to one-half of the height of the support ring 414.

For purposes of connecting the connector 410 to a printed circuit board (PCB) 424, the connector 410 is press-fit in a hole in the PCB 424 and then wave-soldered 427 to the PCB 424. A cap 426 may be press-fit into the inside of the support ring 414 to prevent solder from entering the connector 410 during wave-soldering. A stop 417 formed on the support ring 414 has a diameter larger than the hole diameter in the PCB 424, and limits the portion of the connector 410 that is inserted into the PCB 424.

Figure 2B:
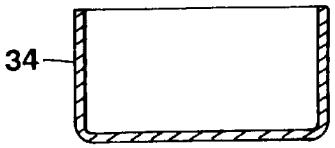
Figure 2E:
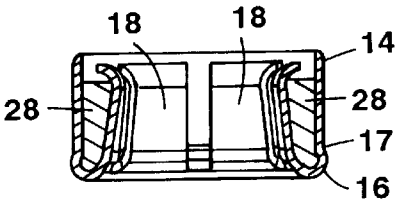
Figure 2D:
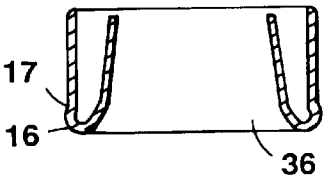
Figure 2C:
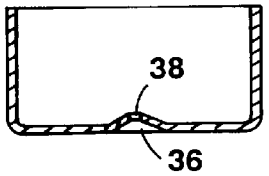
Figure 2A:
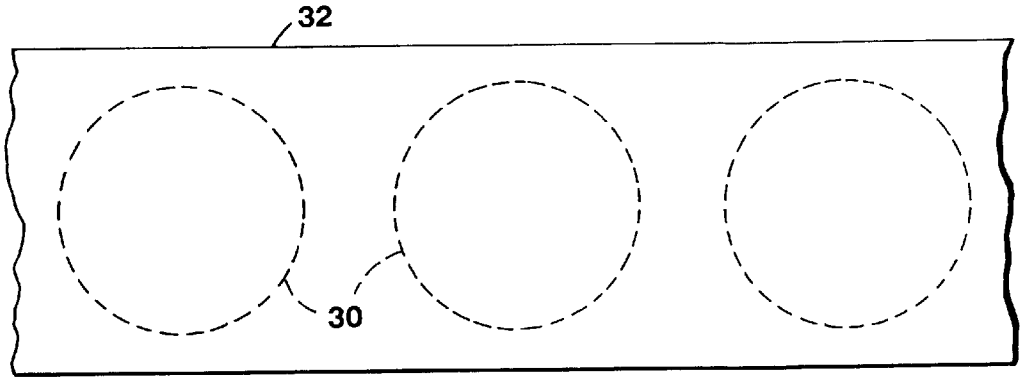

To manufacture the connector 410, a disk of thin (e.g., 0.010 inches) metal (e.g., beryllium copper) is drawn to form a cup 34, as shown in FIGS. 2*a* and *b* and discussed above. A central cylinder 36 is formed by making a hole 38 in the cup 34 (FIG. 2*c*) and drawing the central cylinder according to a proprietary technique held by Braxton Manufacturing, Waterbury, Conn. For purposes of ensuring sufficient resistance for forming the central cylinder 36, the fingers 18 are slit in a predetermined pattern (using a technique employed by Braxton Manufacturing) only after the central cylinder 36 is formed. Various slitting patterns may be used depending on the size of the connector 410 and the number of fingers 418 required.

As shown in FIG. 8*a*, gaps 442 between adjacent fingers 418 may be formed by punching back metal strips 463 between the adjacent fingers 418. The gaps 442 may also be formed by cutting and removing the metal strip 463. As shown in FIGS. 9*a* and 9*b*, the connector 410 may have six instead of four fingers 418.

For purposes of setting the profile (i.e., the portion of the connector 410 that protrudes from the top surface of the PCB 424) of the connector 410, the position of the stop 417 on the support ring 414 may vary. As shown in FIG. 10, a high-profile connector 411 is distinguished by a length L2 of the connector 411 that extends upwardly from the stop 417. In contrast, a low-profile connector 413 (FIG. 11) is almost completely contained within the hole in the PCB board 424 with only a small portion of the connector 413 protruding.

As shown in FIG. 12, the cap 426 may be press-fit into the inside of the connector (e.g., connector 410) to prevent solder from touching the contact ring 414. A lip 465 on the cap 426 helps guide the cap 426 into the connector.

As shown in FIGS. 13 and 14, an electrical adapter 100 has connectors 110 (similar in design to the connectors discussed above) that are aligned by the adapter 100 with five pins 106 (two pins 106*a* and three pins 106*b*) of a circuit module 102 (e.g., a switching power converter). For purposes of releasably connecting five low current signal lines 122 (one for each of the pins 106) of a cable 125 to the pins 106, the adapter 100 has a socket 121 for receiving a female connector 123 of a cable 125. Besides the socket 121 (used for transferring low currents), the adapter 100 also has two power sockets 128 used to transfer large currents between a device plugged into the sockets 128 and two pins 106*a* of the module 102. Instead of the sockets 128, the adapter 100 may have screws or solder pads to connect high current wires to the adapter 100.

For purposes of aligning and holding the pins 106, the adapter 100 has an insulative frame 118 (e.g., a plastic frame). The frame 114 has openings 118 into which the connectors 110 are press-fit.

For purposes of forming the electrical connection between the pins 106*a* and 106*b* and the socket; 121 and 128, the adaptor 100 has zinc lugs 116*a* electrically connected to the connectors 110*a* and zinc lugs 116*b* electrically connected to the connectors 110*b*. The lugs 116 have openings 117 sized to closely circumscribe the top of the connectors 110 where the connectors 110 extend through the openings 118 of the frame 114. For purposes of forming an electrical connection between the lugs 116 and the socket 121, wires 108 (one for each of the lines 122) extend from the socket 121 into holes 129 formed in the lugs 116. Near the holes 129, the wires 108 are soldered to the lugs 116.

For purposes of forming the electrical connection between the pins 106*a* and the power sockets 128, the adapter 100 has zinc lugs 116*b* through which the larger power connectors 110*b* extend. Each of the lugs 116*b* has two blades 127 which form part of the power socket 128.

The frame 114 has depressions 115 in which the lugs 116 rest. The frame 114 is covered by a shell 120 which is mounted (e.g., by screws) to the top of the frame 114. The shell 120 has an opening 133 for the receptacle 121 and four openings 135 for the sockets 128 (one opening 135 for each blade 127).

As shown in FIG. 15, another adapter 200 receives a low current three-wire ribbon cable 202 and two high current litz cables 204, all of which are soldered to circuitry of the adapter 200. The adapter 200 has three low current connectors 206*a* and two high current connectors 206*b* (the connectors 206*a* and 206*b* are of similar design to the connectors discussed above) used to form releasable connections with the corresponding pins 106*a* and 106*b*, respectively, of the module 102.

For purposes of forming electrical connections, the connectors 206*a* and 206*b* are press-fit and soldered into holes 228 of a printed circuit board (PCB) 212. Each connector 206*b* has a sleeve 208 adapted to receive and form an electrical connection (after soldering) with the end of one of the power cables 204. The three wires of the cable 202 are connected to the PCB 212 through three electrical lugs 210 which are mounted to the PCB 212. Each lug 210 is adapted to receive the end of one of the wires of the cable 202 and form an electrical connection (after soldering) with the end of the wire. The PCB board 212 has electrical traces (not shown) used to selectively electrically connect the connectors 206*a* to the lugs 210. Electrical traces on the PCB 212 may be used to selectively electrically connect the connectors 206*b* to the wires of the cable 202.

The PCB 212 (and the inserted connectors 206*a* and 206*b*) are sandwiched between a top plastic shell 214 and a bottom plastic shell 218. The connectors 206*a* and 206*b* are exposed via openings 220 formed in the shell 218. The sleeves 208 are seated in depressions 226 of the shell 218, and the connectors and the lugs 210 are seated in a depression 224 of the shell 218.

As shown in FIGS. 16, 17 and 18 (which shows section 18—18 of FIG. 16), a surface-mountable adapter 300 is used to mount the module 102 to a PCB 310. The adapter 300 has a low profile, insulative frame 301 which positions two high current connectors 302*b* (for the pins 106*b*) and three low current connectors 302*a* (for the pins 106*a*) close to the PCB 310. The connectors 302 are of similar design to the connectors discussed above. Electrical traces 328 (FIG. 18) on the PCB 310 are used to selectively connect circuitry on the PCB 310 to the connectors 302.

The frame 301 has circularly cylindrical holes 304 for receiving and holding the connectors 302. Each connector 302 is electrically and mechanically attached to a ring 312. For example, solder 330 may be applied between the outer support ring of the connector and the inner surface of a cylindrical section 313 of the ring 312. One way to apply the solder is to place a ring-shaped solder preform around the outside of connector 302; insert the connector 302 into the ring 312 so that the preform is positioned at the top edge 319 of the cylindrical section; and heat the assembly to flow the solder into the gap (the gap may be maintained by inwardly dimpling the wall of the connector 302). The ring 312 also has an outer rim 315 which extends radially outward from the end of the cylinder 313 closest to the PCB 310. The rim 315 serves as a stop to limit the travel of the ring 312 within the hole 304. As shown in FIG. 18, the assembly comprising the connector 302 and the ring 312 is inserted into the hole 304 and is held in place by a retaining tab 332. Spacer tabs 335 provide mechanical support for the frame 301 in regions between holes 304.

To secure the frame 301 to the PCB 310, the frame 301 has two downwardly extending pegs 306 which are positioned for extension into holes 308 formed in the PCB 310. After the surface-mountable adapter 300 is positioned on the PCB 310, the bottoms of rings 312 are connected to traces 328 by means of solder 331. The module may be mounted to the adapter(s) by inserting the pins 106*a* and 106*b* into the connectors 302*a* and 302*b*.

Other embodiments are within the scope of the following claims.

What is claimed is:

1. A surface mountable apparatus for use with a pin and a printed circuit board, comprising:

a frame configured to mount on a surface of the printed circuit board, the frame having a plurality of openings orthogonal to the surface;

connectors mounted in the openings of the frame, a surface-mountable solderable surface for mating with a conductive trace on a surface of the printed circuit board, the solderable surface being electrically connected to at least one of the connectors; and at least one of the connectors having:

a support ring; and a contact ring comprising fingers connected to and integrally formed with the support ring, held in a space within the support ring and defining a channel within the contact ring for receiving the pin.

2. The apparatus of claim 1, wherein the frame further comprises a peg configured to extend into a hole in the printed circuit board, the peg providing mechanical support for the apparatus.

3. The apparatus of claim 1, wherein at least one of the connectors extends through at least one of the openings.

4. The apparatus of claim 1, further comprising at least one mounting ring configured to secure one of the connectors to the frame.

5. The apparatus of claim 4, wherein the printed circuit board has an electrical trace, and wherein the mounting ring is configured to form an electrical connection between the electrical trace and the one of the connectors secured by the mounting ring.

6. The apparatus of claim 1, wherein the frame is elongated, and wherein the connectors are mounted in a single row along the longitudinal length of the frame.

7. A surface-mountable apparatus for use with a pin and a printed circuit board ("PCB"), comprising:

a frame configured to mount on a surface of the PCB, the frame having a plurality of openings orthogonal to the surface of the PCB;

connectors mounted in the openings of the frame;

at least one of the connectors having a solderable surface sitting in one of the openings at an end closest to the PCB for surface-mount mating with a conductive trace on the surface of the PCB.

8. The apparatus of claim 7, wherein the solderable surface of the at least one of the connectors extends through the at least one of the openings.

9. The apparatus of claim 7, wherein:

the at least one of the connectors comprises a tubular body with a first end open to receive the pin and a second closed end, the connector body closely fitting inside the at least one opening with the closed end closest to the surface of the PCB.

10. The apparatus of claim 9, wherein:

the at least one of the connectors further comprises a mounting ring having a tubular section and a base, the tubular section being configured to mate with the tubular body;

the solderable surface comprises the base; and the mounting ring is configured to secure the at least one of the connectors to the frame with the tubular section extending into the opening from an end closest to the surface of the PCB and the base being adjacent to and forming an electrical connection with the trace.

11. The apparatus of claim 10, wherein the tubular section of the mounting ring is soldered to the tubular body.

12. The apparatus of claim 11, wherein the opening comprises a contour for retaining the connector within the opening.

13. The apparatus of claim 11, wherein the mounting ring further comprises an outer rim for retaining the connector within the opening.

14. A low profile adapter for connecting one or more pins to a wire comprising:

a housing having a top face and a bottom defining a low profile and an edge forming a perimeter of the adapter, and having first openings in the bottom for accepting the pins, and a second opening in the edge for accepting the wire, the wire being generally orthogonal to the pins;

connectors located inside the housing, each of the connectors configured to grip and form an electrical connection with a respective one of the pins;

a frame having openings for holding the connectors;

a first conductive lug associated with a first respective one of the connectors, the lug having a terminal for connection with the wire oriented orthogonally to the axis of the first respective one connector, the first conductive lug establishing an electrical connection between the first respective one connector and the wire.

15. The adapter of claim 14 further comprising:

a second conductive lug configured to receive the wire; and wherein the frame comprises a printed circuit board ("PCB") parallel to the top face, having a hole for receiving a second respective one of the connectors, and having a trace electrically connecting the second conductive lug to the second respective one connector.

16. The adapter of claim 15 wherein the PCB further comprises a hole for receiving the first respective one of the connectors.

17. The adapter of claim 16 further comprising a third conductive lug configured to receive the wire; and wherein the PCB further comprises a trace electrically connecting the third conductive lug to the first respective one connector.

18. The adapter of claim 1 wherein the first conductive lug provides a high current connection and the second and third conductive lugs provide low current connections.

19. The adapter of claim 18 wherein the wire comprises a flat high-current conductor and the sleeve is adapted to receive the high-current conductor.

20. The adapter of claim 15 wherein the first conductive lug provides a high current connection and the second conductive lug provides a low current connection.

21. The adapter of claim 15 wherein the wire comprises a ribbon cable having a plurality of conductors, the second conductive lug comprises a plurality of lugs, each lug in the plurality of lugs configured to receive a respective conductor in the plurality of conductors, the hole comprises a plurality of holes, each hole in the plurality of holes for receiving a respective one of the connectors, and the trace comprises a plurality of traces, each trace in the plurality of traces for electrically connecting a respective one of the lugs in the plurality of lugs to a respective one of the connectors.

22. The adapter of claim 14 wherein the terminal comprises a sleeve for receiving the wire.

23. The adapter of claim 14 wherein the terminal comprises at least one blade.

24. An adapter for use with a first connector and a pin, comprising:

a second connector configured for engaging and making electrical connection with the pin, a conductive lug having an first opening for receiving and making electrical connection with the second connector, a conductive terminal orthogonal to the second connector and extending from the lug for connective engagement by the first connector, an insulative frame having an second opening for receiving the second connector, an insulative shell for mounting to the frame, the shell having a third opening configured with the conductive terminal to form a socket for mating with and making an electrical connection with the first connector when the first connector is inserted into the socket.

25. The adapter of claim 24 wherein the terminal comprises a blade.

26. The adapter of claim 24 wherein the blade comprises a pair of parallel blades.

27. The adapter of claim 24 wherein the terminal comprises a cylindrical conductor.

28. The adapter of claim 24 wherein the terminal comprises a wire.

29. The adapter of claim 28 wherein the second terminal further comprises a sleeve for making a connection with a high current wire.

30. The adapter of claim 28 wherein the second terminal further comprises an opening for making a solder connection with a wire.

31. The adapter of claim 28 wherein the second terminal further comprises a screw for connecting a wire to the terminal.

32. The adapter of claim 24 further comprising a third connector configured for enagaging and making electrical connection with a second pin, a second conductive lug having a first opening for receiving and making electrical connection with the third connector, a second conductive terminal orthogonal to the connector and extending from the second lug for establishing a high current connection, and wherein the insulative frame further comprises a third opening for receiving the third connector, and the shell further comprises a fourth opening for the second terminal.

33. The adapter of claim 32 further comprising a second socket for mating with and making a high-current electrical connection with a fourth connector when the fourth connector is inserted into the socket, the second socket comprising the fourth opening and the second terminal, and wherein the second terminal further comprises a blade.

34. The adapter of claim 24 wherein the second connector is press fit into the second opening of the shell.

35. The apparatus of claim 1, 7, 10, or 14 wherein at least one of the connectors, or of claim 32 wherein at least one of the second or third connectors, further comprises:

a support ring; and a contact ring connected to and integrally formed with the support ring, held in a space within the support ring and defining a channel within the contact ring for receiving the pin, the contact ring comprising three or more fingers arranged radially around said contact ring and connected at an end closest to the pin insertion end of the connector to the support ring by a section having a bend of 90 degrees or more, the contact ring being configured to provide a contact region contacting the pin when the pin is inserted.

36. The apparatus of claim 35 wherein:

the support ring is cylindrical;

the contact ring is cylindrical;

the fingers are arranged at generally equal intervals around the contact ring;

the channel includes a contact zone which is located along a longitudinal axis of the channel and is narrower than an outside circumference of the pin; and the fingers are resilient with respect to the support ring to apply radially inward forces on the pin.

37. The apparatus of claim 35 wherein the fingers apply a force to the pin; and further comprising:

a resilient ring held in the space between the support ring and the contact ring, the resilient ring expanding with increased temperature and configured so that as it expands it applies a force to the contact ring which enhances the force applied by the contact ring to the pin.

38. The apparatus of claim 35 wherein:

the fingers are resilient with respect to the support ring to apply radially inward forces on the pin, and each of the fingers, when the pin is inserted within the connector, touches the inside of the support ring at a point which is on the other end from where the finger is connected to the support ring.

39. The apparatus of claim 35 wherein the fingers are resilient with respect to the support ring to apply radially inward forces on the pin, and further comprising:

a cap including a top surrounded by a rim for sealing the end of the connector that is opposite the channel for receiving the pin.

40. The apparatus of claim 35 wherein:

at least one of the fingers has a bent zone near a free end of the finger that bends toward the support ring.

41. The apparatus of claim 35 further comprising:

at least one tab located between adjacent fingers and being connected to and integrally formed with the support ring, the tab being held in space within the support ring and being closer to the support ring than the adjacent fingers.

42. The apparatus of claim 35 wherein the fingers are resilient with respect to the support ring to apply radially inward forces on the pin, and further comprising:

at least one of the fingers having a free end that is held in space prior to insertion of the pin and contacts the support ring after insertion of the pin.

43. The apparatus of claim 35 wherein the contact region contacts the pin along its length when the pin is inserted.

* * * * *